US009869168B2

(12) United States Patent
Lin et al.

(10) Patent No.: US 9,869,168 B2
(45) Date of Patent: Jan. 16, 2018

(54) METHOD FOR THERMAL-DISPLACEMENT-TYPE STRENGTHENED EXTRACTION IN DRILL HOLE

(71) Applicant: China University of Mining and Technology, Xuzhou, Jiangsu (CN)

(72) Inventors: Baiquan Lin, Jiangsu (CN); Yidou Hong, Jiangsu (CN); Chuanjie Zhu, Jiangsu (CN); Hao Yao, Jiangsu (CN)

(73) Assignee: CHINA UNIVERSITY OF MINING AND TECHNOLOGY, Xuzhou, Jiangsu (CN)

( * ) Notice: Subject to any disclaimer, the term of this patent is extended or adjusted under 35 U.S.C. 154(b) by 0 days.

(21) Appl. No.: 15/323,272

(22) PCT Filed: Dec. 9, 2015

(86) PCT No.: PCT/CN2015/096789
§ 371 (c)(1),
(2) Date: Dec. 30, 2016

(87) PCT Pub. No.: WO2016/112759
PCT Pub. Date: Jul. 21, 2016

(65) Prior Publication Data

US 2017/0152734 A1 Jun. 1, 2017

(30) Foreign Application Priority Data

Jan. 12, 2015 (CN) ..... 2015 1 0014227

(51) Int. Cl.
*E21B 43/24* (2006.01)
*E21B 33/14* (2006.01)
*E21B 43/30* (2006.01)

(52) U.S. Cl.
CPC ..... *E21B 43/24* (2013.01); *E21B 33/14* (2013.01); *E21B 43/30* (2013.01)

(58) Field of Classification Search
CPC ..... E21B 43/24; E21B 43/14; E21B 43/30
(Continued)

(56) References Cited

U.S. PATENT DOCUMENTS 4,026,356 A * 5/1977 Shuck ..... E21B 7/14 166/245
9,417,358 B2 8/2016 Lin et al.
(Continued)

FOREIGN PATENT DOCUMENTS

CN 101294500 A 10/2008
CN 101503957 A 8/2009
(Continued)

OTHER PUBLICATIONS

PCT International Search Report, PCT/CN2015/096789, dated Mar. 22, 2016.
(Continued)

*Primary Examiner* — Silvana Runyan
(74) *Attorney, Agent, or Firm* — TraskBritt, P.C.

(57) ABSTRACT

A method for thermal-displacement-type strengthened extraction in a drill hole, suitable for efficient gas extraction in a coal mine, the method comprising the following steps: arranging an extraction drill hole and a thermal displacement drill hole at intervals in a coal seam; continuously heating coal in the drill hole to form a stable temperature field by using a heat pipe; and significantly reducing gas adsorption potential by utilizing a heat effect, prompting gas desorption, and strengthening gas extraction. The method enlarges a range of effective pressure relief influence of a single hole, increases an extraction efficiency of gas in a coal seam by
(Continued)

more than 40%, is safe, reliable and low-cost, and is easy to operate, saving both time and labor.

1 Claim, 1 Drawing Sheet

(58) Field of Classification Search
USPC ..... 166/285
See application file for complete search history.

(56) References Cited

U.S. PATENT DOCUMENTS

| | | | | |
|---|---|---|---|---|
| 2003/0173085 | A1 | 9/2003 | Vinegar et al. | |
| 2005/0016729 | A1 * | 1/2005 | Savage | E21B 41/0085 166/302 |
| 2015/0159470 | A1 | 6/2015 | Lin et al. | |
| 2016/0136575 | A1 | 5/2016 | Lin et al. | |

FOREIGN PATENT DOCUMENTS

| | | | |
|---|---|---|---|
| CN | 101832149 | A | 9/2010 |
| CN | 102400669 | A | 4/2012 |
| CN | 103114871 | A | 5/2013 |
| CN | 104533514 | A | 4/2015 |
| WO | 2013163645 | A1 | 10/2013 |
| WO | 2016112759 | A1 | 7/2016 |

OTHER PUBLICATIONS

PCT International Search Report and Written Opinion, PCT/CN2015/096789, dated Mar. 22, 2016.

* cited by examiner

METHOD FOR THERMAL-DISPLACEMENT-TYPE STRENGTHENED EXTRACTION IN DRILL HOLE

CROSS-REFERENCE TO RELATED APPLICATIONS

This application is a national phase entry under 35 U.S.C. §371 of International Patent Application PCT/CN2015/096789, filed Dec. 9, 2015, designating the United States of America and published as International Patent Publication WO 2016/112759 A1 on Jul. 21, 2016, which claims the benefit under Article 8 of the Patent Cooperation Treaty to Chinese Patent Application Serial No. 201510014227.6, filed Jan. 12, 2015.

TECHNICAL FIELD

The application relates to a method for gas extraction enhanced by thermal displacement in boreholes, particularly applicable to efficient gas extraction from a coal seam with high gas concentration and low air permeability under a coal mine.

BACKGROUND

An essential means for gas control in the coal mines in, for example, China is gas extraction, mainly gas extraction by drilling boreholes. As the mining work has evolved to deep mining in China, the low air permeability in the coal seams has become a dominant factor that constrains efficient gas extraction. Therefore, enhanced permeability improvement has become a key technique for improving the gas extraction effect and realizing co-mining of deep coal and gas extraction. The enhanced permeability improvement methods adopted at present mainly include two methods: one method is coal mass treatment by means of fluid machinery and fluid medium in combination, such as hydraulic slotting and hydraulic fracturing, etc.; the other method is fracturing the coal mass by means of explosive explosion, etc. Both methods can improve the air permeability in the coal seam and improve the gas extraction effect, but have their drawbacks. When a hydraulic slotting or hydraulic fracturing method is used, a water blocking effect, etc., may occur and thereby inhibit gas desorption. When an explosion method is used, planting the explosive wastes time and energy, and the explosive is a source of danger itself and brings certain threat to safe downhole production. Therefore, it is necessary to seek for an enhanced permeability improvement measure that is safe, reliable, time and labor saving, easy to implement, and low in cost. Such a measure is of great significance for improving the gas extraction efficiency and preventing coal and gas outburst in coal mines.

Researchers have demonstrated that the gas adsorption potential of a coal mass decreases as the temperature increases. The decreased gas adsorption potential is beneficial for gas desorption from the coal mass. Hence, if a temperature field can be applied to the coal mass artificially, the gas desorption from the coal mass will be promoted effectively.

BRIEF SUMMARY

Technical problem: in order to overcome the drawbacks in the prior art, this disclosure provides a method for gas extraction enhanced by thermal displacement in boreholes, which is safe and reliable, time and labor saving, easy to implement, and low in cost.

Technical solution: The method for gas extraction enhanced by thermal displacement in boreholes provided in this disclosure comprises drilling boreholes crossing a coal seam or drilling boreholes down the coal seam as follows: arranging a plurality of extraction borehole sites at an interval in the coal seam; and drilling extraction boreholes, sealing the boreholes, and connecting the boreholes into a gas extraction pipe network for gas extraction sequentially, through the following steps:

a. arranging a plurality of thermal displacement boreholes among the plurality of extraction boreholes in a way that the thermal displacement boreholes and the extraction boreholes are arranged in a staggered manner;

b. drilling a thermal displacement borehole, inserting a grouting pipe, a return pipe, a heat pipe, and an extraction pipe into the thermal displacement borehole after withdrawing the drill stem, connecting the exposed end of the grouting pipe to a grouting pump, connecting the exposed end of the extraction pipe to a gas extraction pipe network, and installing a heating device on the exposed section of the heat pipe sequentially;

c. starting the grouting pump to inject grout into the thermal displacement borehole through the grouting pipe, stopping grouting when the grout flows out from the return pipe, and sealing the thermal displacement borehole;

d. starting the heating device, the heat pipe absorbing heat from the heating device and thereby releasing heat into the thermal displacement borehole continuously, so as to increase the temperature in the borehole and in the coal mass around the borehole, and thereby promoting gas desorption from the coal mass in the area and realizing thermal displacement type enhanced extraction;

e. repeating the above steps to continue thermal displacement type enhanced extraction in another area.

Beneficial effects: the method provided in this disclosure utilizes a heat pipe to release heat continuously into a borehole, and thereby forms a high-temperature field by continuously heating up the coal mass in the borehole or the coal mass around the borehole. Utilizing a rule that the gas absorption potential in a coal mass decreases as the temperature of the coal mass increases, the method is used to promote gas desorption and thereby attain a purpose of enhanced gas extraction. Thus, the influence area of an effective pressure relief of individual boreholes is remarkably enlarged, and the efficiency of gas extraction from the coal seam is improved by 40% or more. The method is safe and reliable, low in cost, simple and easy to implement, time and labor saving, and has high practicality.

Figure 1:
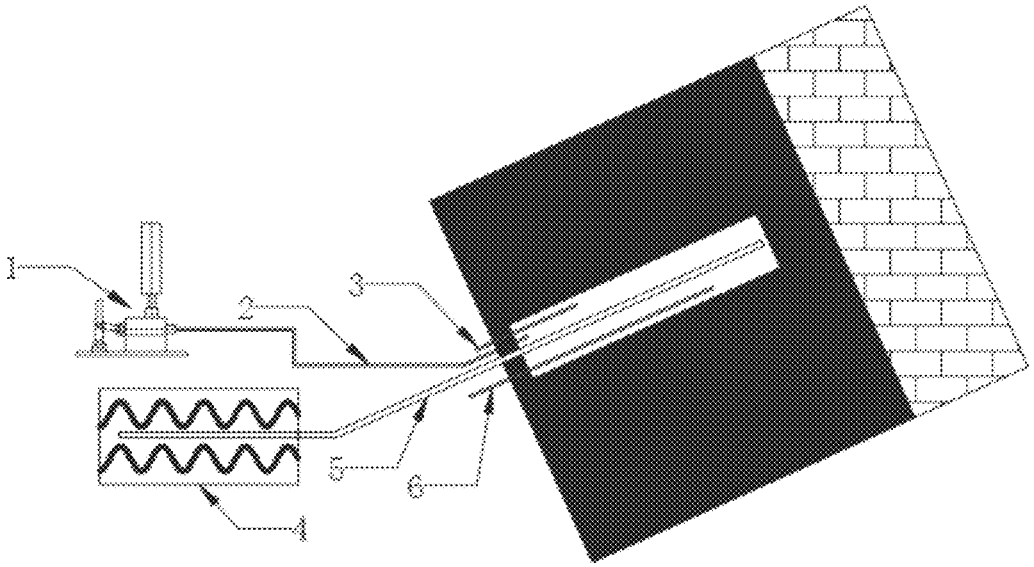
FIG. 1 is a schematic diagram of the method for gas extraction enhanced by thermal displacement in boreholes according to this disclosure.

Among the figures, the following reference numerals and definitions are used: 1—grouting pump; 2—grouting pipe; 3—return pipe; 4—heating device; 5—heat pipe; and 6—extraction pipe.

DETAILED DESCRIPTION

This disclosure will be hereinafter detailed in an embodiment with reference to the accompanying drawings.

Figure 2:
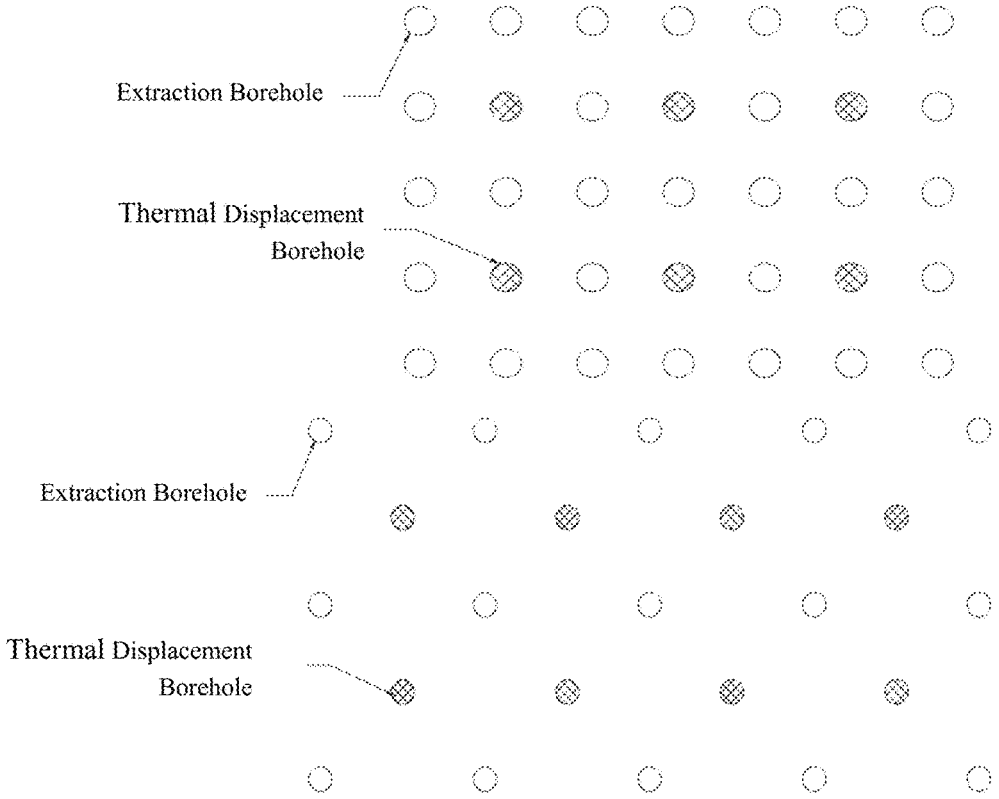
FIG. 2 is a schematic diagram of staggered arrangement of extraction boreholes and thermal displacement boreholes according to this disclosure.

The method for gas extraction enhanced by thermal displacement in boreholes provided in this disclosure comprises drilling boreholes crossing a coal seam and drilling boreholes down the coal seam:

a. arranging extraction borehole sites at an interval in the coal seam in a way that the extraction boreholes are within the scope of influence of thermal displacement boreholes;

b. sequentially drilling extraction boreholes, sealing the boreholes, and connecting the boreholes into a gas extraction pipe network for gas extraction;

c. arranging a plurality of thermal displacement boreholes among the plurality of extraction boreholes in a way that the thermal displacement boreholes and the extraction boreholes are arranged in a staggered manner, as shown in FIG. 2;

d. sequentially drilling a thermal displacement borehole; inserting a grouting pipe 2, a return pipe 3, a heat pipe 5, and an extraction pipe 6 into the thermal displacement borehole after withdrawing the drill stem; connecting the exposed end of the grouting pipe 2 to a grouting pump 1; connecting the exposed end of the extraction pipe 6 to a gas extraction pipe network; and installing a heating device 4 on the exposed section of the heat pipe 5;

e. starting the grouting pump 1 to inject grout into the thermal displacement borehole through the grouting pipe 2, stopping grouting when the grout flows out from the return pipe 3, and sealing the thermal displacement borehole;

f. after the borehole is sealed, starting the heating device 4, the heat pipe 5 absorbing heat from heating device 4 and thereby releasing heat into the thermal displacement borehole continuously, so as to increase the temperature in the borehole and in the coal mass around the borehole, thereby promoting gas desorption from the coal mass in the area and realizing thermal displacement type enhanced extraction;

g. repeating the steps c to f to continue thermal displacement type enhanced extraction in a next area.

In the borehole drilling crossing the coal seam, the distance between center of the extraction borehole and center of the terminal end of the thermal displacement borehole is 6 to 8 m. In the borehole drilling down the coal seam, the distance between center of the extraction borehole and center of the opening end of the thermal displacement borehole is 3 to 5 m.

The heating device employs a water circulation heating method or an electrically heated tube heating method.

The heating device is a hermetically sealed container and has been subjected to treatment for explosion-proofing. The heating element of the heating device is submerged in water and heats up the heat pipe by heating up the water, or is isolated from the ambient environment and heats up the heat pipe by thermal radiation and thermal convection, and does not make contact with the heat pipe or the downhole air directly. The heat pipe consists of a pipe shell, a wick, and an end cap, and is a mature heat radiator product in the market. The heat pipe utilizes a liquid filled in the pipe to absorb heat at one end and release heat at the other end, thereby realizing heat transfer.

The invention claimed is:

1. A method for gas extraction enhanced by thermal displacement in boreholes, comprising drilling boreholes crossing a coal seam or drilling boreholes down the coal seam, the method comprising:

arranging a plurality of extraction borehole sites at an interval in the coal seam; and sequentially drilling extraction boreholes, sealing the boreholes, and connecting the boreholes into a gas extraction pipe network for gas extraction, through the following steps:

a. arranging a plurality of thermal displacement boreholes among the plurality of extraction boreholes in a way that the thermal displacement boreholes and the extraction boreholes are arranged in a staggered manner;

b. drilling a thermal displacement borehole, inserting a grouting pipe, a return pipe, a heat pipe, and an extraction pipe into the thermal displacement borehole after withdrawing the drill stem; connecting the exposed end of the grouting pipe to a grouting pump; connecting the exposed end of the extraction pipe to a gas extraction pipe network; and installing a heating device on the exposed section of the heat pipe sequentially;

c. starting the grouting pump to inject grout into the thermal displacement borehole through the grouting pipe, stopping grouting when the grout flows out from the return pipe, and sealing the thermal displacement borehole;

d. starting the heating device, the heat pipe absorbing heat from the heating device, thereby releasing heat into the thermal displacement borehole continuously, so as to increase the temperature in the borehole and in the coal mass around the borehole, thereby promoting gas desorption from the coal mass in the area and realizing thermal displacement type enhanced extraction; and e. repeating steps a to d to continue thermal displacement type enhanced extraction in another area;

wherein in the borehole drilling crossing the coal seam, the distance between center of the extraction borehole and center of terminal end of the thermal displacement borehole is six (6) to eight (8) meters;

wherein in the borehole drilling down the coal seam, the distance between center of the extraction borehole and center of opening end of the thermal displacement borehole is three (3) to five (5) meters;

wherein the heating device employs water circulation heating or an electrically heated tube, and wherein the heating device is a closed container, which is subjected to a flameproof treatment, a heating element thereof being immersed in water, heated by heating water to heat the heat pipe or isolated from the surrounding environment, heated by heat radiation and heat convection to the heat pipe without direct contact with the heat pipe and without direct contact with air under the mine.

* * * * *